United States Patent [19]

Tarrant

[11] 4,250,639

[45] Feb. 17, 1981

[54] MEMORANDUM PAD-CALENDAR

[76] Inventor: Kent Tarrant, 210 Maple St., Springfield, Mass. 01105

[21] Appl. No.: 17,488

[22] Filed: Mar. 5, 1979

[51] Int. Cl.[3] ..... G09D 3/00

[52] U.S. Cl. ..... 40/107

[58] Field of Search ..... 40/120, 530, 107, 10 R; 402/70, 90 P, 501

[56] References Cited

U.S. PATENT DOCUMENTS

| | | | |
|---|---|---|---|
| 409,340 | 8/1889 | Unz | 281/15 B |
| 2,570,439 | 10/1951 | Forca | 248/463 X |
| 2,829,457 | 4/1958 | Marston | 40/120 |
| 3,234,673 | 2/1966 | Cook | 40/10 R |
| 4,170,423 | 10/1979 | Bourbon | 402/70 |

*Primary Examiner*—Gene Mancene
*Assistant Examiner*—Wenceslao J. Contreras
*Attorney, Agent, or Firm*—Chapin, Neal & Dempsey

[57] ABSTRACT

A memorandum pad-calendar comprising a base, including an inclined sheet supporting panel or wall having a sheet retention means disposed thereon and a sheet receiving compartment disposed below the inclined panel. Sheets having memoranda recording spaces on the front faces thereof and calendars printed on the back faces are releasably disposed on the inclined panel such that the sheets when overturned are automatically removed from the retention means and drop into the compartment. The compartment includes therewithin a stop which props the overturned sheets up against an inclined back wall thereby simultaneously exposing a calendar on the back face of a sheet with the front of the next succeeding sheet. Those dates on the calendar corresponding to the memoranda spaces on the next succeeding sheet may be italicized or otherwise accentuated.

15 Claims, 6 Drawing Figures

MEMORANDUM PAD-CALENDAR

BACKGROUND

This invention relates to a memorandum pad-calendars of the type having a plurality of sheets, each divided into a number of blank spaces on which memoranda and the like is recorded, each space corresponding to a calendar date.

It is an object of the present invention to provide an improved memorandum pad-calendar.

It is another object of the present invention to provide a memorandum pad-calendar wherein efficient use is made of both the front and backsides of the pad sheets.

It is another object of the present invention to provide a memorandum pad-calendar wherein the memoranda recording spaces on one of the sheets are simultaneously viewable with a calendar disposed on the reverse side of a preceding sheet which includes the dates corresponding to these spaces.

It is yet another object of the present invention to provide a memoranda pad-calendar which is compact, economical to manufacture and attractive in appearance.

SUMMARY OF THE INVENTION

These and other objects will become more readily apparent from the following detailed description taken in connection with the appended claims and accompanying drawings wherein there is disclosed a memorandum pad-calendar having a base which includes an upper panel or wall adapted to releasably support a multiplicity of memorandum sheets by means of a sheet retention means disposed on that panel. The base also includes a compartment defined in part by the upper panel and disposed immediately below said panel. As the sheets are successively released from the upper panel, they are overturned and drop into the compartment such that a backside portion of each released sheet remains visible simultaneously with the front of the next sheet remaining on the upper panel. The visible sheet backside portions have calendars printed thereon and the sheet fronts have thereon memorandum recording spaces for one or more days which fall within the time period of the calendar of the next preceding (overturned) sheet. Simultaneous exposure of the sheet backs and fronts enables a user to review memorandum recorded for particular days simultaneously with the calendar period in which those days fall.

DESCRIPTION OF THE PREFERRED EMBODIMENT

Figure 1:
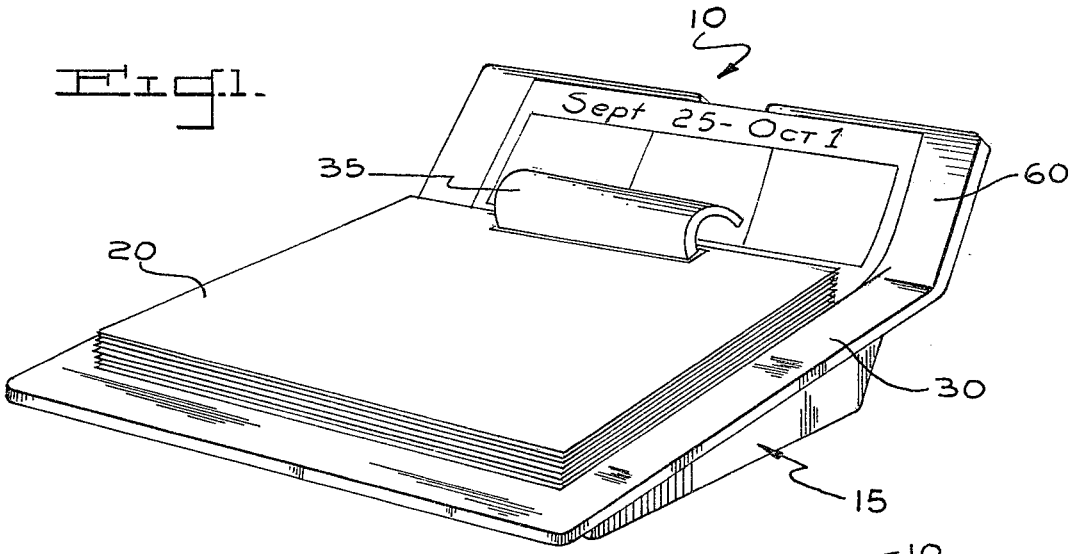
FIG. 1 is a perspective view of the memorandum-pad calendar of the present invention.

Referring to the drawings, the memorandum pad-calendar of the present invention is shown generally at 10 and comprises a base 15 which supports a multiplicity of memorandum recording sheets 20 thereon and which includes a compartment 25 which receives used sheets therein.

The base may be formed from any suitable material of the necessary strength and rigidity such as any of various suitable plastics as, for example, by molding. The base comprises an upper inclined wall or panel or sheet supporting portion 30 which supports the unused memorandum sheets, the upper panel being provided thereon with a sheet retention means comprising a ring or element 35 or other suitable means which removably holds the sheets on that panel. While ring 35 is generally elongated for rendering the stack of sheets stable, it will, of course, be understood that a plurality of spaced thin rings may be employed along the rear edge of the upper panel 30 with equal utility. Of course, it will be understood that sheets 20 will be punched to mate with whatever type of binding means is used.

Figure 4:
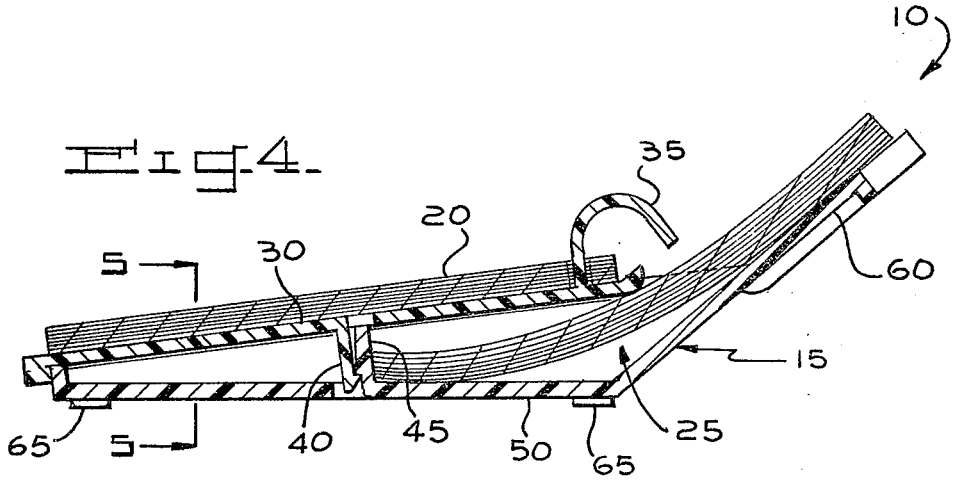
FIG. 4 is a sectional view taken along line 4—4 of FIG. 3.
Figure 5:
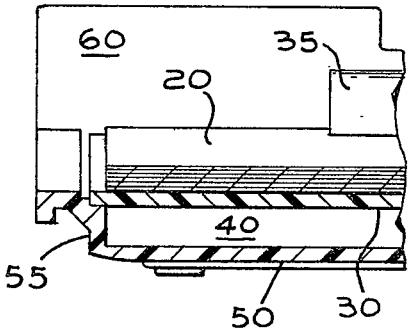
FIG. 5 is a fragmentary sectional view taken along line 5—5 of FIG. 4.

As best seen in FIG. 4, panel 30 is provided on the underside thereof with a lug 40 which interlocks with a mating lug 45 extending upwardly from the base bottom wall 50, the interlocked lugs maintaining the assembly of the upper panel and bottom wall. The base also includes sidewalls 55 and an inclined back wall 60 which are conveniently formed integral with the bottom wall whereby the base is easily and efficiently assembled merely by snapping lugs 40 and 45 together. Bottom wall 50 may also be provided with protective feet 65.

Again, as best seen in FIG. 4, inclined panel 30 and bottom wall 50 which converge toward their forward edges, define in part sheet receiving means or compartment 25, the opening thereof being defined by the rear edge of inclined top panel 30, back wall 60 and sidewalls 55. Compartment 25 also includes a stop comprising lug 45 which engages the tops of the overturned sheets thus propping the sheets placed into compartment 25 against the back wall 60 as shown.

Figure 2:
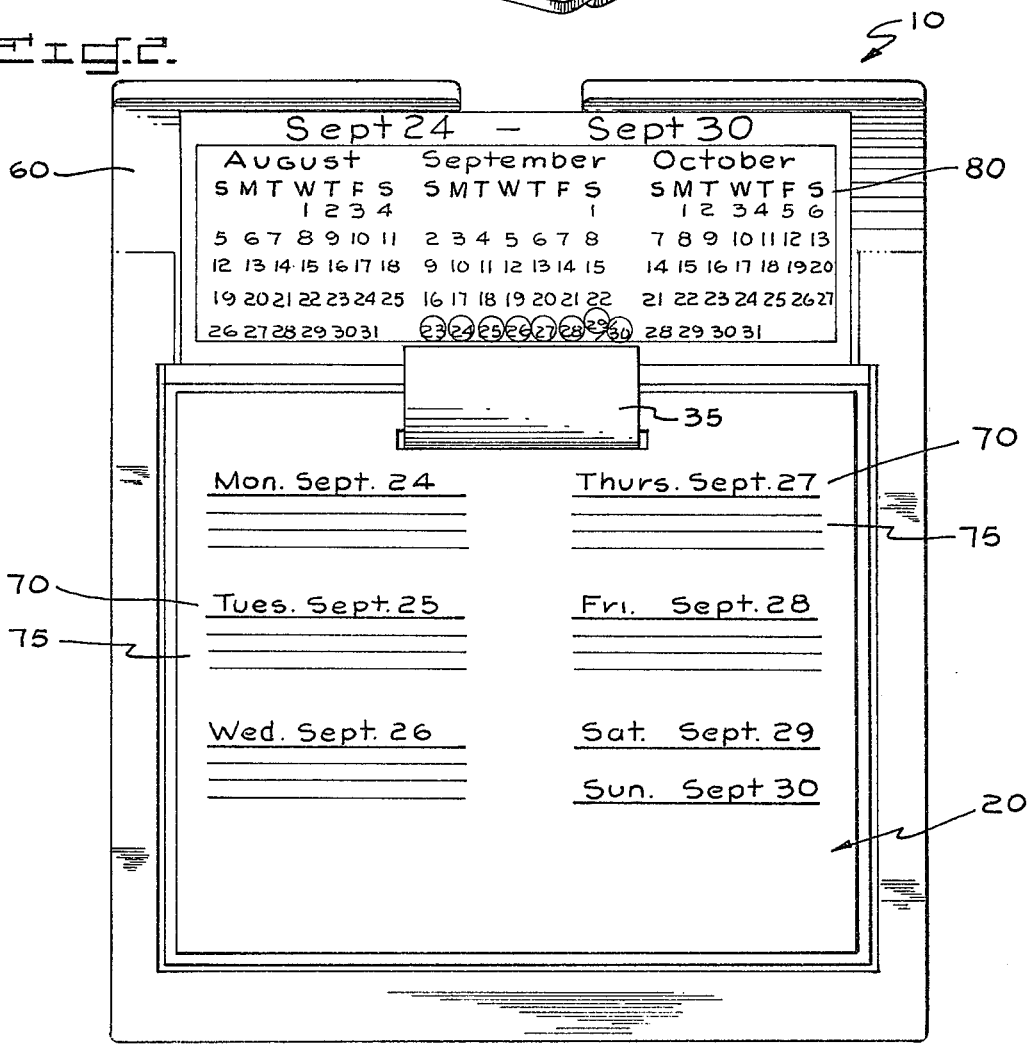
FIG. 2 is a top plan view of the memorandum-pad calendar showing details of the memoranda sheets employed therewith.
Figure 3:
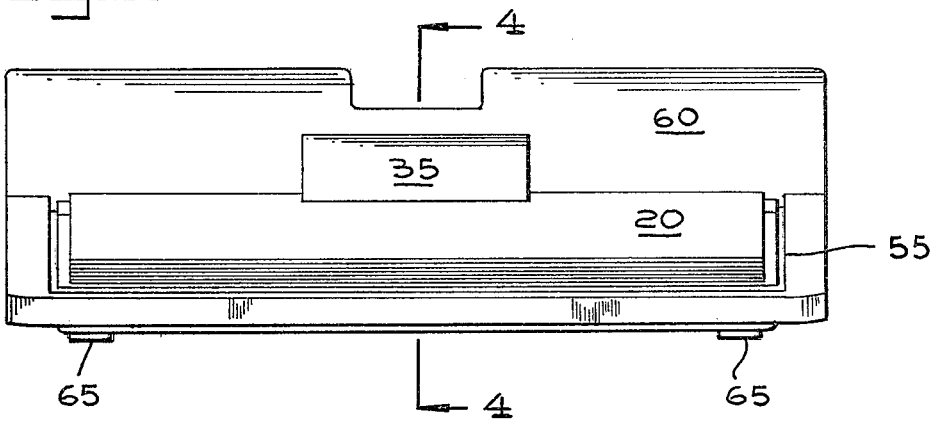
FIG. 3 is a front elevation of the memorandum-pad calendar.

Referring to FIG. 2, each of the sheets 20 has printed thereon a plurality of dates 70, each date heading a corresponding blank space 75 on which notes, memoranda and the like may be conveniently recorded. While in the preferred embodiment, memo spaces for one calendar week are provided on the front of each sheet, it will be appreciated that each sheet may accommodate more or less days as dictated by, for example, sheet size.

The bottom of the backside of each of sheets 30 has a calendar 80 printed thereon, which calendar includes those dates corresponding to the days of the week imprinted on the front of the next succeeding sheet. While in the preferred embodiment each of these calendars comprises a three month calendar wherein the dates corresponding to the next sheet's memo spaces are included in the second month, it will be appreciated that more or less extensive calendars may be employed without departing from the present invention. In the preferred embodiment, those dates on calendar 80 corresponding to the memo spaces on the next sheet are italicized or otherwise suitably a accentuated or highlighted over the remaining dates so that when a user views the memos on a sheet simultaneously with the calendar, he or she will be able to readily determine the amount of time between the memo dates and other dates of interest, such as vacations, holidays, engagements or the like.

The memorandum pad-calendar is loaded with sheets 20 by threading the sheets over ring 35. As each successive sheet is used up, it is turned over ring 35, the relative disposition of inclined panel 30 and bottom wall 50 being such that when each sheet disengages the ring it drops overturned into compartment 25 such that only the portion of the sheet which remains visible is the bottom of each sheet backside, that portion on which the calendar is printed. Thus, both the fronts and backs of the sheets are efficiently used while only printed portions of the sheet backsides remain visible thereby rendering the memorandum pad-calendar of the present invention compact and attractive yet efficient.

Figure 6:
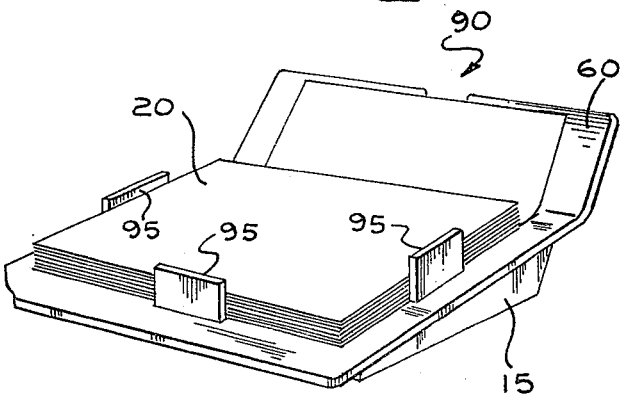
FIG. 6 is a perspective view of an alternate embodiment of the memorandum pad calendar.

Referring to FIG. 6, an alternate embodiment of the memorandum pad-calendar of the present invention is shown at 90. This memorandum pad-calendar is substantially the same as that described hereinabove with the exception of the sheet retention means. In this embodiment, rather than a ring or other means threaded through the sheets, the sheets are retained on the upper inclined panel by a plurality of tabs 95 upstanding from that panel, the sheets being received between the tabs. Of course, in this embodiment the sheets are not required to be punched. While three tabs are shown, each being in the neighborhood of 1/5 to ⅓ the length of the adjacent sheet edge, it will be understood that greater or lesser numbers of tabs of various lengths may be employed. The tabs may be of such length as to join one another to define a continuous wall surrounding the sheets either completely or on three sides thereof. The memorandum pad-calendar of this embodiment is used as that shown in FIGS. 1–5. That is, the sheets 20 have imprinted on the fronts and backs thereof the indicia shown in FIG. 2. As each sheet is used up, it is overturned about the top edge thereof dropping into the compartment and resting against back wall 60, such that the calendar imprinted on the bottom of the sheet backside remains simultaneously visible with the front of the next succeeding sheet.

Having thus described the invention, what is claimed is:

1. Memorandum pad-calendar comprising a base having a portion adapted to support a multiplicity of memoranda sheets thereon; binding means passing through an aperture in each of the sheets for releasably retaining said sheets on said sheet support portion such that the sheets are individually and sequentially removable from said sheet support portion by overturning the sheets; and a sheet receiving means disposed adjacent said sheet support portion such that said sheets, when released from said binding means, drop into said receiving means, portions of the overturned sheets being visible simultaneously with the sheets remaining on said sheet support portion.

2. Memorandum pad-calendar according to claim 1 wherein said sheet receiving means is disposed below said sheet support portion.

3. Memorandum pad-calendar according to claim 1 wherein the memoranda sheet fronts are imprinted with days of the week and include blank spaced on which information may be recorded and the visible portion of each of the overturned sheets is provided with a calendar, a portion of which includes dates corresponding to said imprinted days of the week on the front of the next succeeding sheet.

4. Memorandum pad-calendar according to claim 3 wherein said corresponding dates are accentuated over the remainder of said calendar dates.

5. Memorandum pad-calendar according to claim 1 wherein said binding means comprises at least one open ring.

6. Memorandum pad-calendar according to claim 8 wherein said upper wall is inclined and said upper and bottom walls converge toward the forward edges thereof, said upper wall having extending from the bottom thereof a lug which interfits with said stop for maintenance of the assembly of said upper and bottom walls.

7. Memorandum pad-calendar comprising a base, said base including an upper wall for supporting thereon a multiplicity of paper sheets, sheet retention means including at least one open ring disposed on said upper wall, a bottom wall disposed beneath and spaced from said upper wall to define therewith an open compartment between said bottom and upper walls and a back wall, against which sheets in said compartment may be supported, said back wall being rearwardly spaced from said upper wall, said spacing between said back and upper walls defining an opening through which sheets released from said retention means are received into said compartment.

8. Memorandum pad-calendar comprising:

(a) a base, said base including an upper wall for supporting thereon a multiplicity of paper sheets;

(b) sheet retention means disposed on said upper wall;

(c) a bottom wall disposed beneath said upper wall and defining therewith an open compartment;

(d) a back wall, against which sheets in said compartment may be supported, said back wall being rearwardly spaced from said upper wall, said spacing defining an opening through which sheets released from said retention means are received into said compartment; and (e) a stop disposed between said upper wall and said bottom wall, said stop engaging said overturned sheets and propping said overturned sheets against said back wall.

9. Memorandum pad-calendar according to claim 8 wherein said back wall is inclined rearwardly from the rear edge of said bottom wall, said base further including a pair of upstanding side walls extending from said bottom wall to said upper wall and enclosing the sides of said compartment.

10. Memorandum pad-calendar according to claim 9 wherein said bottom, side and back walls are integral with one another.

11. Memorandum pad-calendar according to claim 8 wherein said retention means comprises at least one open ring.

12. Memorandum pad-calendar according to claim 8 wherein the memoranda sheet fronts are imprinted with days of the week and include blank spaces on which information may be recorded and the visible portion of each of the overturned sheets is provided with a calendar, a portion of which includes dates corresponding to said imprinted days of the week on the front of the next succeeding sheet.

13. Memorandum pad-calendar according to claim 8 wherein said corresponding dates are accentuated over the remainder of said calendar dates.

14. Memorandum pad-calendar according to claim 8 wherein said sheet retention means comprises a plurality of retaining tabs upstanding from said upper wall.

15. Memorandum pad-calendar according to claim 8 wherein said sheet retention means comprises a plurality of tabs upstanding from said upper wall, said sheets being received and retained by said tabs.

* * * * *